US007954891B2

(12) United States Patent
Lin et al.

(10) Patent No.: US 7,954,891 B2
(45) Date of Patent: Jun. 7, 2011

(54) FOLDABLE CHAIR WITH RETRACTABLE ARMRESTS

(76) Inventors: Mei Chuen Lin, Taoyuan Hsien (TW); Tzu Mei Wang, Taoyuan Hsien (TW)

( * ) Notice: Subject to any disclaimer, the term of this patent is extended or adjusted under 35 U.S.C. 154(b) by 85 days.

(21) Appl. No.: 12/437,744

(22) Filed: May 8, 2009

(65) Prior Publication Data

US 2010/0283296 A1 Nov. 11, 2010

(51) Int. Cl.
*A47C 4/04* (2006.01)

(52) U.S. Cl. ..... 297/38; 297/28; 297/40; 297/41

(58) Field of Classification Search ..... 297/27, 297/28, 38, 40, 41
See application file for complete search history.

(56) References Cited

U.S. PATENT DOCUMENTS

| | | | | |
|---|---|---|---|---|
| 1,945,018 | A * | 1/1934 | Boardman | 297/40 |
| 2,316,484 | A * | 4/1943 | Maurer | 297/40 |
| 2,701,007 | A * | 2/1955 | Hickok | 297/40 |
| 2,996,331 | A * | 8/1961 | Clarin | 297/38 X |

* cited by examiner

*Primary Examiner* — Anthony D Barfield
(74) *Attorney, Agent, or Firm* — Rabin & Berdo, P.C.

(57) ABSTRACT

A foldable chair has an armrest retracting structure that includes two plate elements placed below each armrest, each plate element having a guide slot with a linear section and a reverse turn section. A first pivotal axle passes through the plate elements and connects with the front leg frame. A support beam has an end through which a second pivotal axle is mounted, the second pivotal axle being connected with the front leg frame. An opposite end of the support beam is secured in the slots through a bolt. By moving the support beam, the armrest can be deployed or retracted. When the bolt is lodged in the reverse turn section, the armrest can be locked in the deployed position.

9 Claims, 14 Drawing Sheets

FOLDABLE CHAIR WITH RETRACTABLE ARMRESTS

BACKGROUND OF THE INVENTION

1. Field of the Invention

The present invention generally relates to a foldable chair, and more particularly, to a foldable chair having selectively retractable and extendable armrests.

2. The Prior Arts

Metallic foldable chairs currently commercialized usually do not have armrests to facilitate storage by allowing placement of the collapsed chairs parallel with each other. Other available designs with armrests usually consist of foldable chairs formed by assembling a lightweight chair frame with a plastic fabric. Such structures usually include multiple folding sections, more particularly at the armrests to facilitate storage. However, owing to the many folding sections, the structure of the chair frame becomes more complex, and the folding structure at the armrests is usually not applicable for the above-described metallic foldable chair.

FIG. 8 shows a conventional metallic foldable chair provided with an armrest retracting structure. The armrest includes an armrest pad A and a support beam B. A first pivotal link D is assembled between an end of the support beam B and the rear leg frame C. A surface of the support beam B proximate to the first pivotal link D is fixed with a connecting piece F of the front leg frame E. A second pivotal link G is assembled between another end of the support beam B and a bottom of the armrest pad A. A third pivotal link H is assembled between a distal end of the armrest pad A and the front leg frame E. For retracting the armrests of the foldable chair, the rear leg frame C is moved to lie in a position overlapping parallel with the front leg frame E. As a result, the support beam B is pushed upward through action of the first pivotal link D, and the front end of the armrest pads A rotates downward to contact with the surface of the support beam B through action of the second pivotal link G and third pivotal link H. Accordingly, the armrests are retracted to lie parallel with the front leg frame.

While the foregoing foldable chair can fold the armrests, the armrests are still coupled with the rear leg frame and the diverse pivotal links are coupled with one another. As a result, the armrests are extended and retracted along with the chair body, and cannot be operated independently. Therefore, a user having a body larger than the width between the two armrests cannot sit on the chair.

SUMMARY OF THE INVENTION

One objective of the present invention is to provide a foldable chair that allows a user to desirably retract or extend the armrests while the chair is unfolded.

Another objective of the present invention is to provide a foldable chair that can fold and retract the armrests to a position parallel with the chair body also in a folded position. Storage of the chair is thereby facilitated by allowing placement of multiple similar chairs parallel with one another.

According to one embodiment, the foldable chair comprises a front leg frame and a rear leg frame pivotally connected with each other, each of two symmetrical sides of the front leg frame includes an armrest, a support beam being assembled between each armrest and the front leg frame. The foldable chair is characterized in that a first pivotal link is assembled between the front leg frame and the armrest, a second pivotal link is assembled between the support beam and the front leg frame, and a rail is assembled between the armrest and the support beam, the rail including a locking portion. The armrest and the support beam can rotate relative to the first and second pivotal link, respectively. Guided by the rail, the armrest can be movable to the retracted and extended position. Through the locking portion, the armrest can be secured in the extended or deployed position.

The armrest retracting structure according to the present invention is simple in design. Placed between the armrest and the front leg frame, the armrest retracting structure does not increase the volume of the chair. In use, a user can decide whether to raise the armrests for use. To facilitate the operation of the chair, an instruction label may be provided on the chair to illustrate how to operate the support beam and armrests. Because a torque spring is coupled between the second pivotal link and the support beam, unfolding of the armrest by the support beam will load the spring. When the support beam disengages the locking portion, the resilient force loaded in the spring is released to move the support beam and pull the armrest downward, without the need of external force. When the armrest is laid downward in the retracted position, the surface of the armrest has a same inclination as the front leg frame. Accordingly, when the entire chair is folded, the rear leg frame, the seat and the armrests can thus be folded to lie in a plane parallel with the front leg frame. Multiple chairs folded in this manner can thus be conveniently placed parallel to one another within a minimum storage space.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENTS

Figure 1:
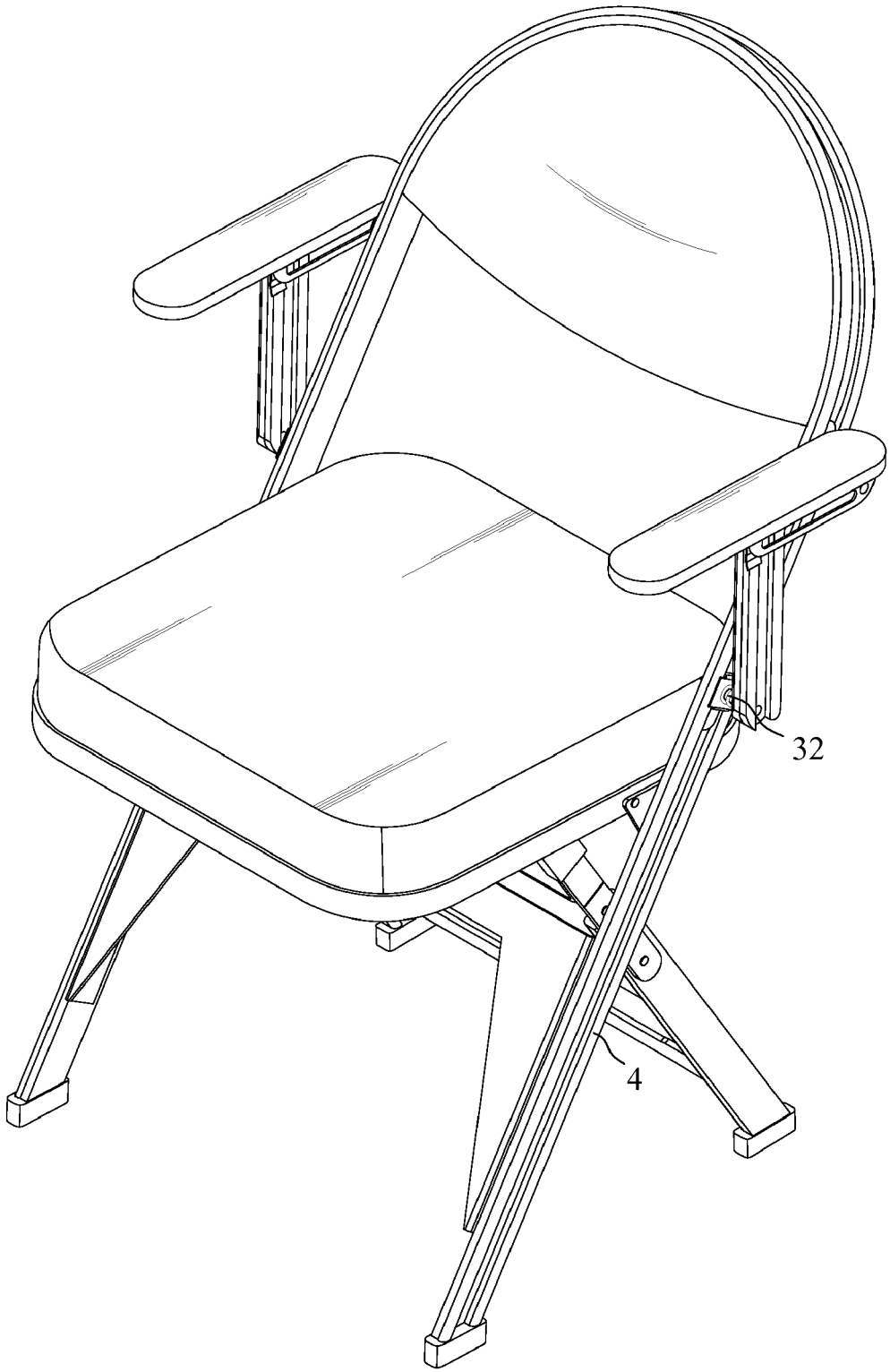
FIG. 1 is a perspective view of a foldable chair according to one embodiment of the present invention.

FIG. 1 is a perspective view of a foldable chair according to an embodiment of the present invention. The foldable chair includes two armrest retracting structures provided symmetrically on a front leg frame 4. The following description will be made with respect to one armrest retracting structure.

Figure 2:
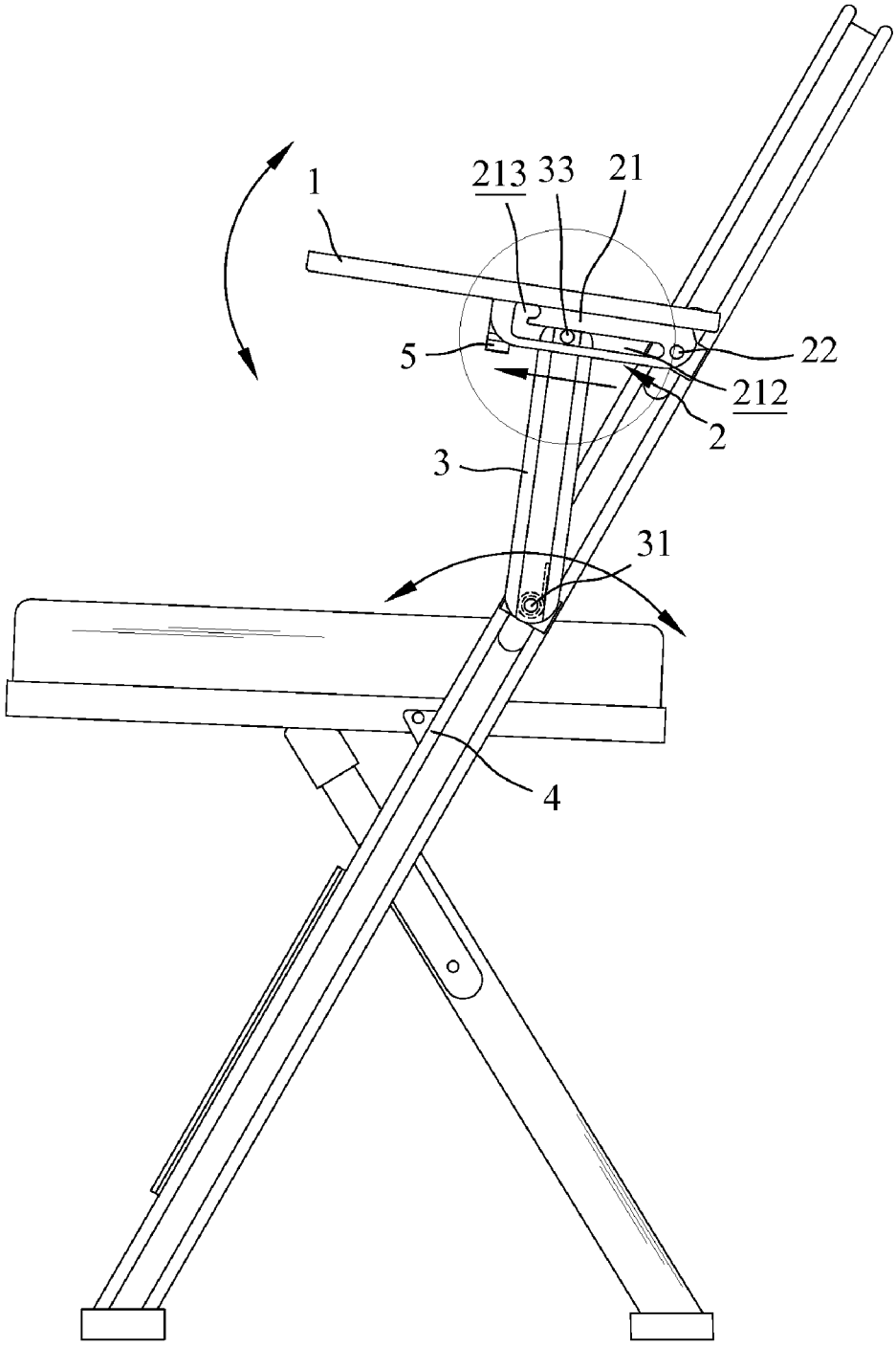
FIG. 2 is a side view of a foldable chair according to one embodiment of the present invention.
Figure 3:
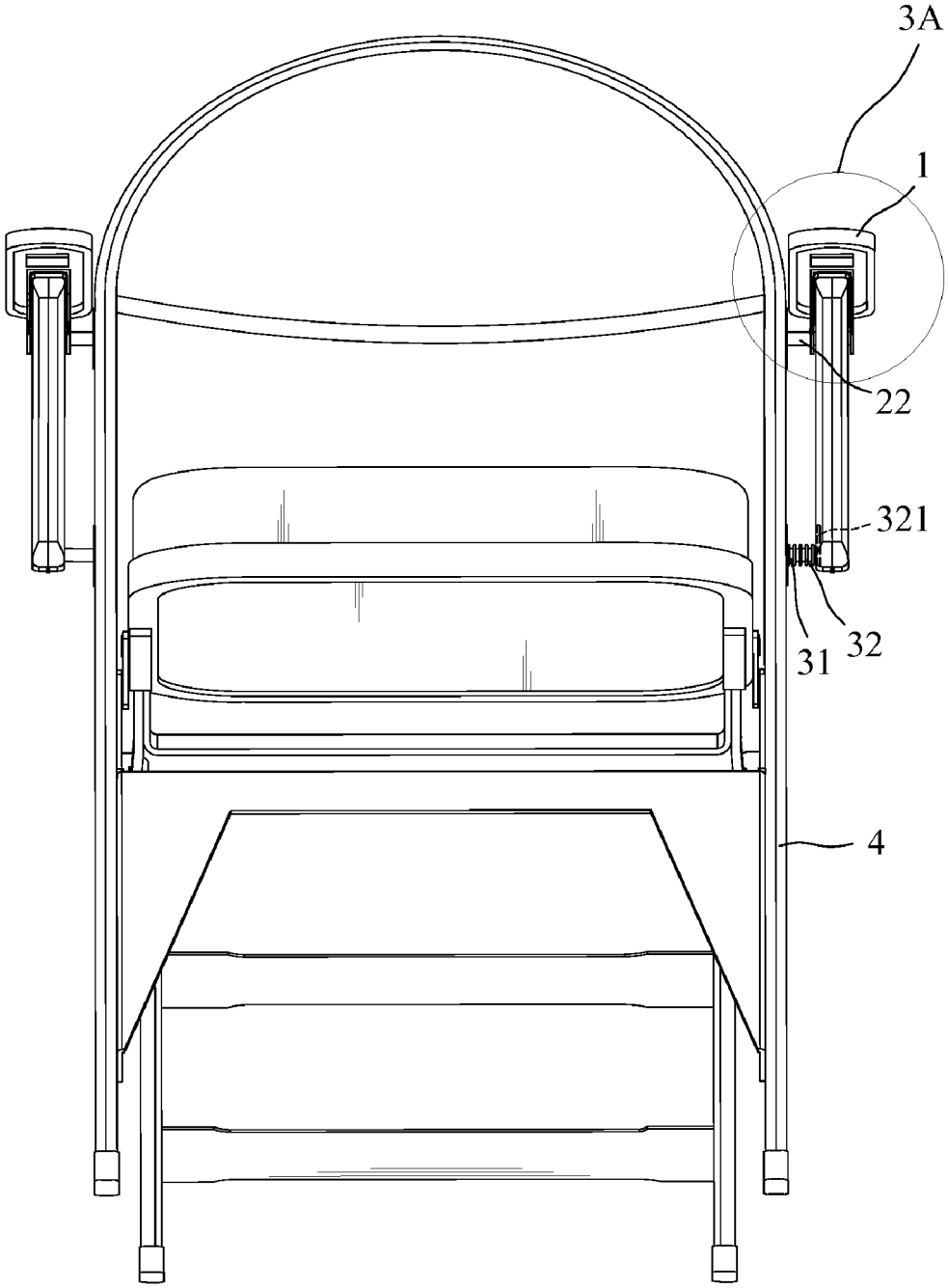
FIG. 3 is a front view of a foldable chair according to one embodiment of the present invention.
Figure 3A:
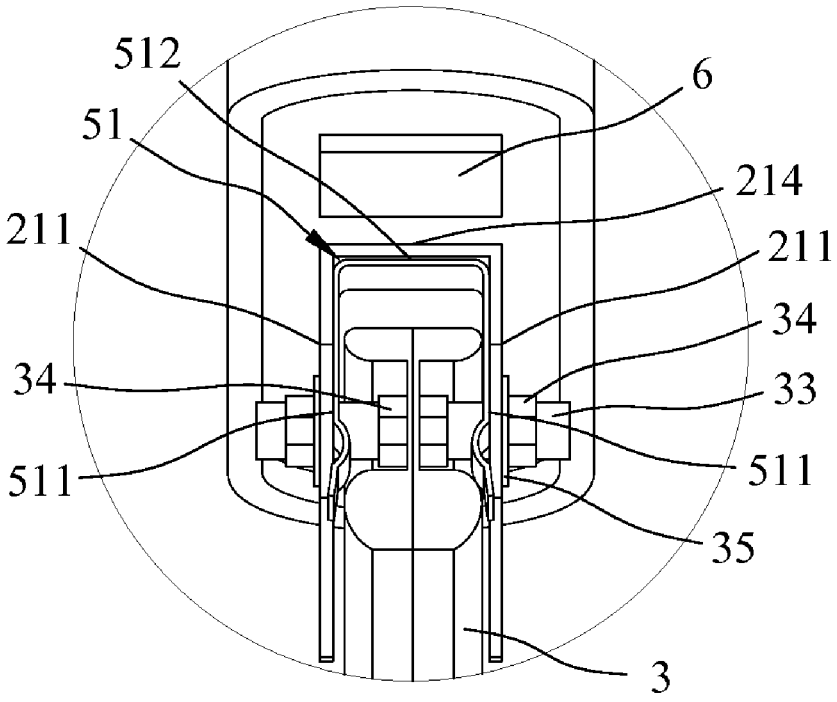
FIG. 3A is an enlarged view of a portion of FIG. 3.

Referring to FIGS. 2, 3 and 3A, the armrest retracting structure comprises an armrest 1, a rail 2, and a support beam 3. The rail 2 includes a U-shaped plate 21 having two symmetrical surfaces 211 each respectively provided with a guide slot 212. The guide slot 212 includes a linear section continuously connected with a reverse turn section 213. A third surface 214 of the U-shaped plate 21 is fixed with a bottom of the armrest 1. Therefore, the two symmetrical surfaces 211 of the U-shaped plate 21 are perpendicular to the armrest 1. A first pivotal axle 22 passes through the two symmetrical surfaces 211 of the U-shaped plate 21, and then connects with the front leg frame 4. The armrest 1 can thus be turned upward and downward relative to the first pivotal axle 22. An urging member 5 includes a U-shaped plate 51 that is formed by bending a thin metallic plate. The U-shaped plate 51 has two symmetrical surfaces 511 that symmetrically bend outward. A third surface 512 of the U-shaped plate 51 is fixed with the third surface 214 of the U-shaped plate 21. Accordingly, the two symmetrical surfaces 511 of the urging member 5 are also perpendicular to the armrest 1. When a slight pressure is applied on the two symmetrical surfaces 511, the two symmetrical surfaces 511 of the urging member 5 contact with an edge of the two symmetrical surfaces 211 at one end of the U-shaped plate 21. This design can prevent elastic fatigue of the urging member 5. A bottom of the armrest 1 proximate to the urging member 5 also includes a cushion pad 6. The cushion pad 6 can be made of a sponge material, rubber, or like shock-absorbing materials. A second pivotal axle 31 mounted with a torque spring 32 passes through an end of support beam 3. A free end 321 of the torque spring 32 connects lengthwise with the support beam 3. After passing through the support beam 3, the second pivotal axle 31 connects with the front leg frame 4. The support beam 3 can be turned left and right relative to the second pivotal axle 31. Another end of the support beam 3 is secured in the two slots 212 of the rail 2 through a bolt 33. A nut 34 is engaged between the bolt 33 and the two surfaces of the support beam 3, such that the support beam 3 is kept between the two symmetrical surfaces 211 of the U-shaped plate 21. Spray paint can thus be conveniently applied on the surface of the support beam 3. Two ends of the bolt 33 are arranged to cross through the two slots 212, and are respectively coupled with a pad 35 and the nut 34. The bolt 33 thereby is prevented from sliding axially.

Figure 4:
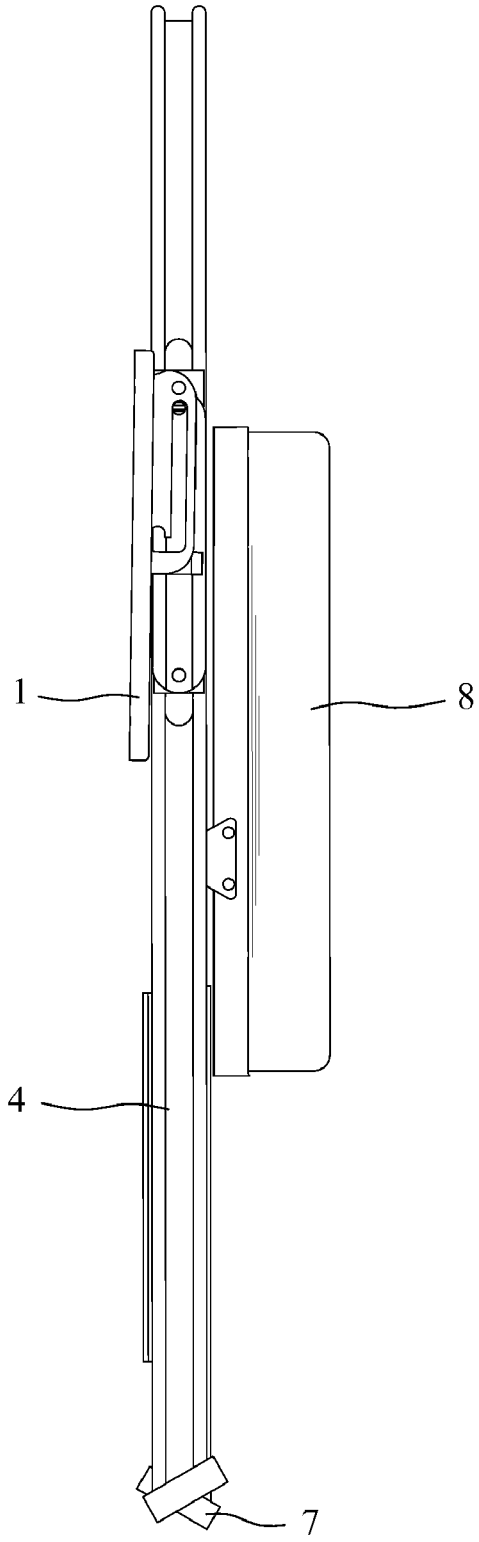
FIG. 4 is side view of a foldable chair in a retracted position according to one embodiment of the present invention.
Figure 4A:
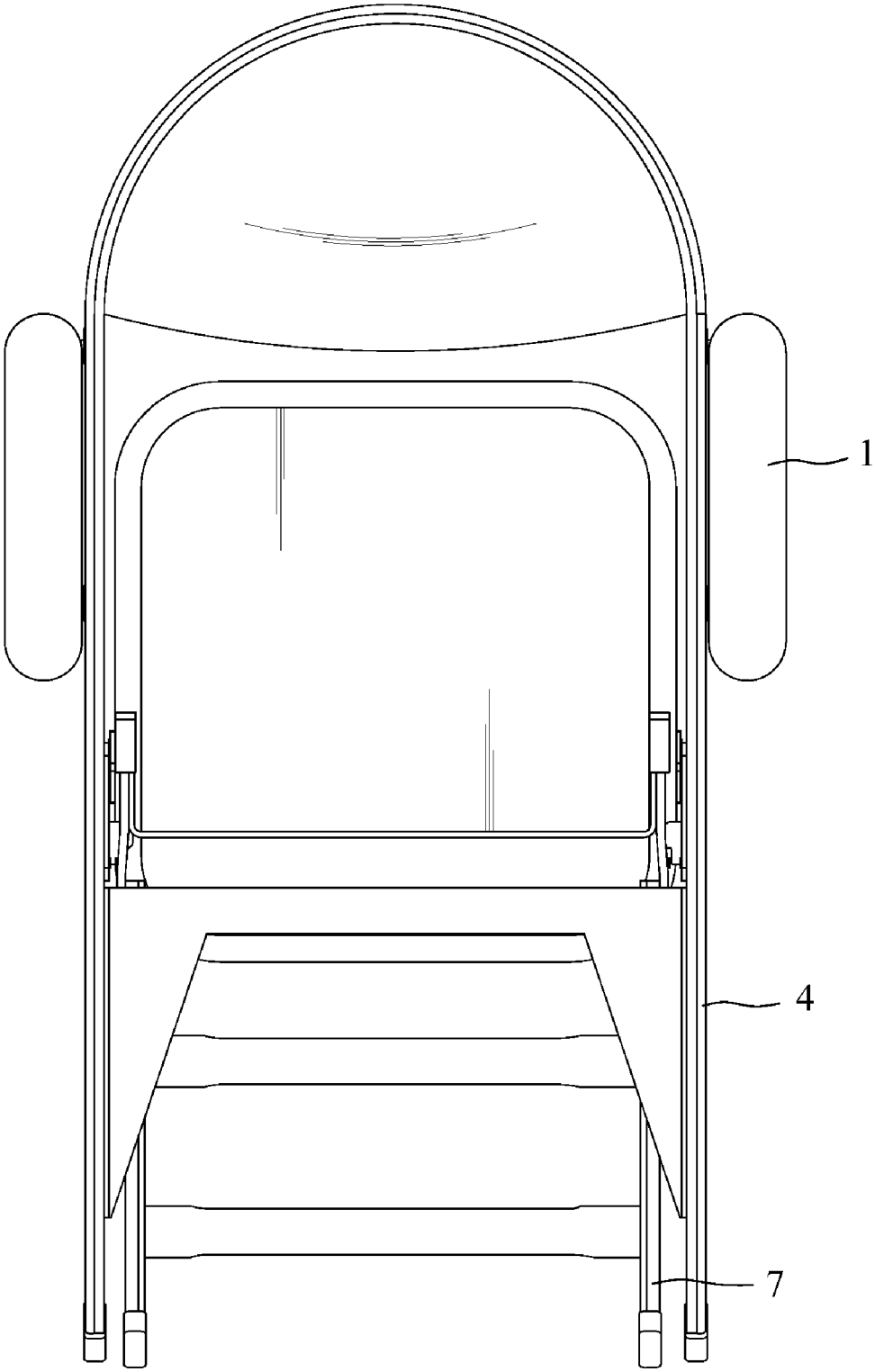
FIG. 4A is a front view of a foldable chair in a retracted position according to one embodiment of the present invention.

FIGS. 4 and 4A are side and front views showing a rear leg frame 7, seat 8 and armrests 1 retracted to a position parallel and overlapping with the front leg frame 4. From a side view, all of the components of the chair after having been retracted lie substantially in a same plane. As a result, storage of multiple folded chairs can be facilitated by gathering them parallel with one another.

Figure 5:
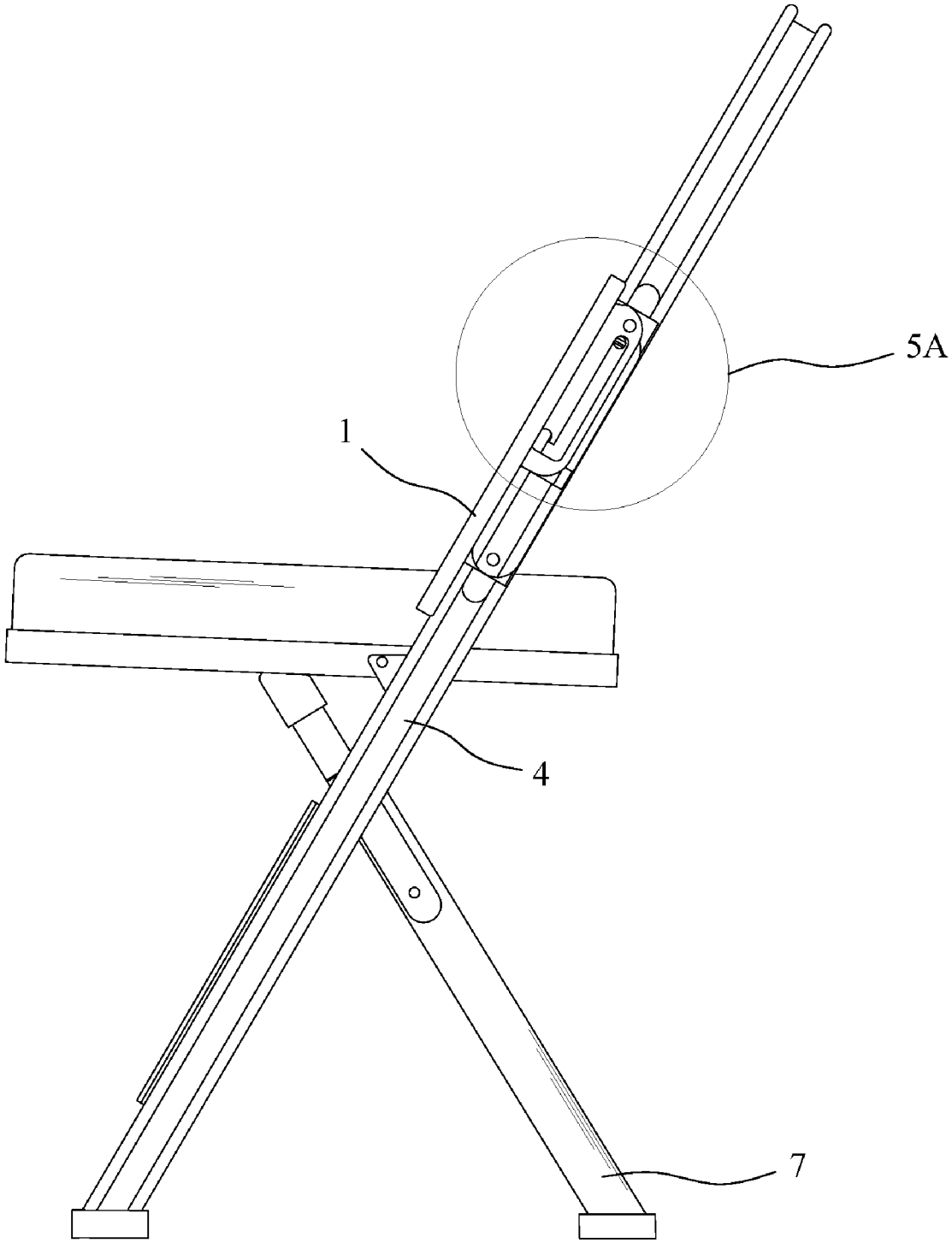
FIG. 5 is a side view of the foldable chair having an armrest not yet extended according to one embodiment of the present invention.
Figure 5A:
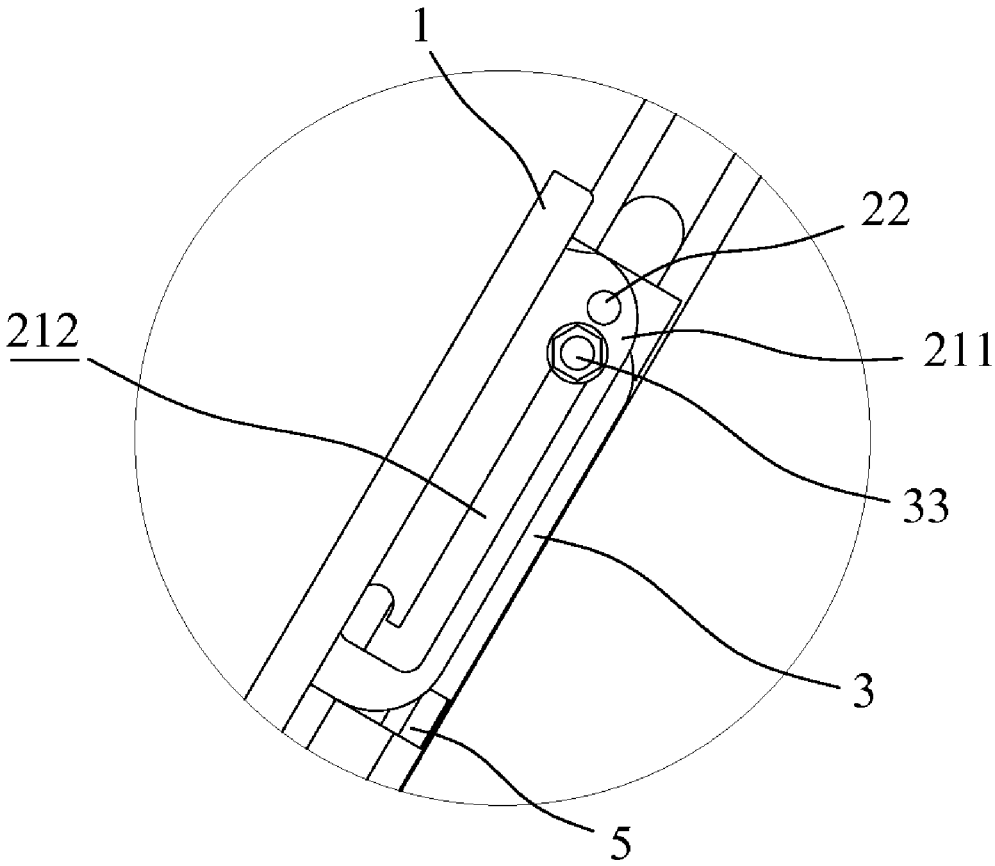
FIG. 5A is an enlarged view of a portion of FIG. 5.
Figure 5B:
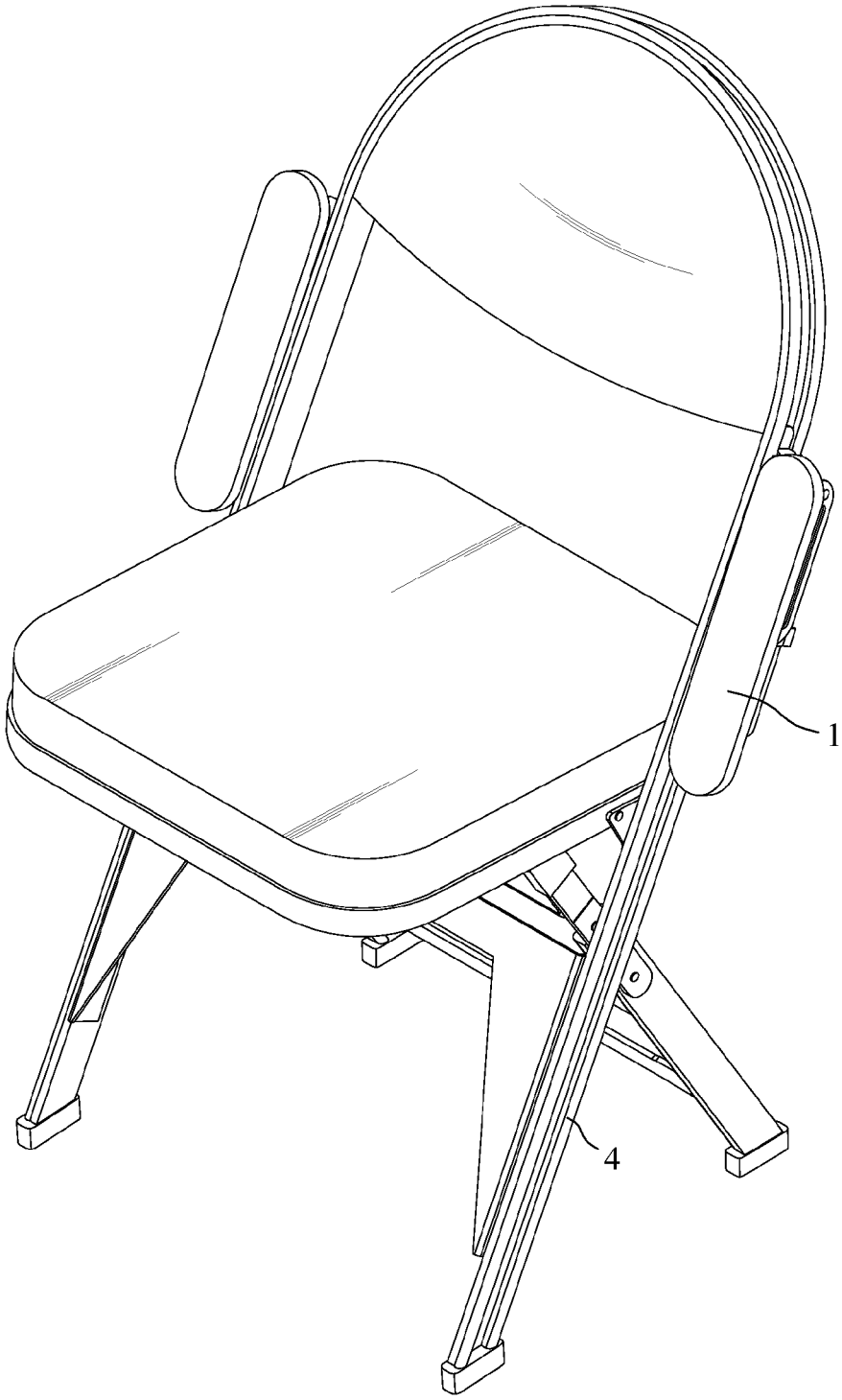
FIG. 5B is a perspective view of the foldable chair having an armrest not yet extended according to one embodiment of the present invention.
Figure 6:
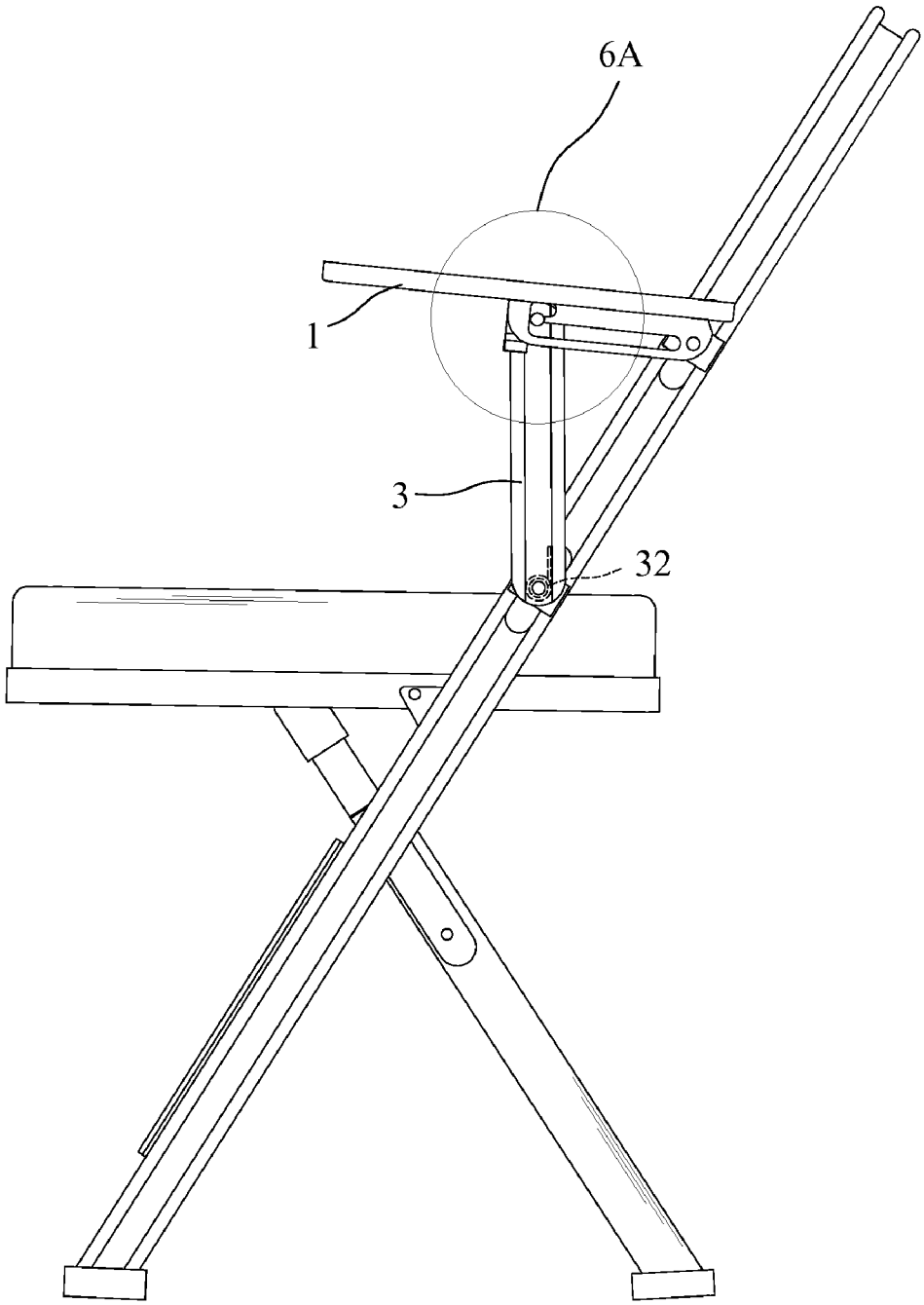
FIG. 6 is a schematic view showing an operation for extending a foldable chair according to an embodiment of the present invention.
Figure 6A:
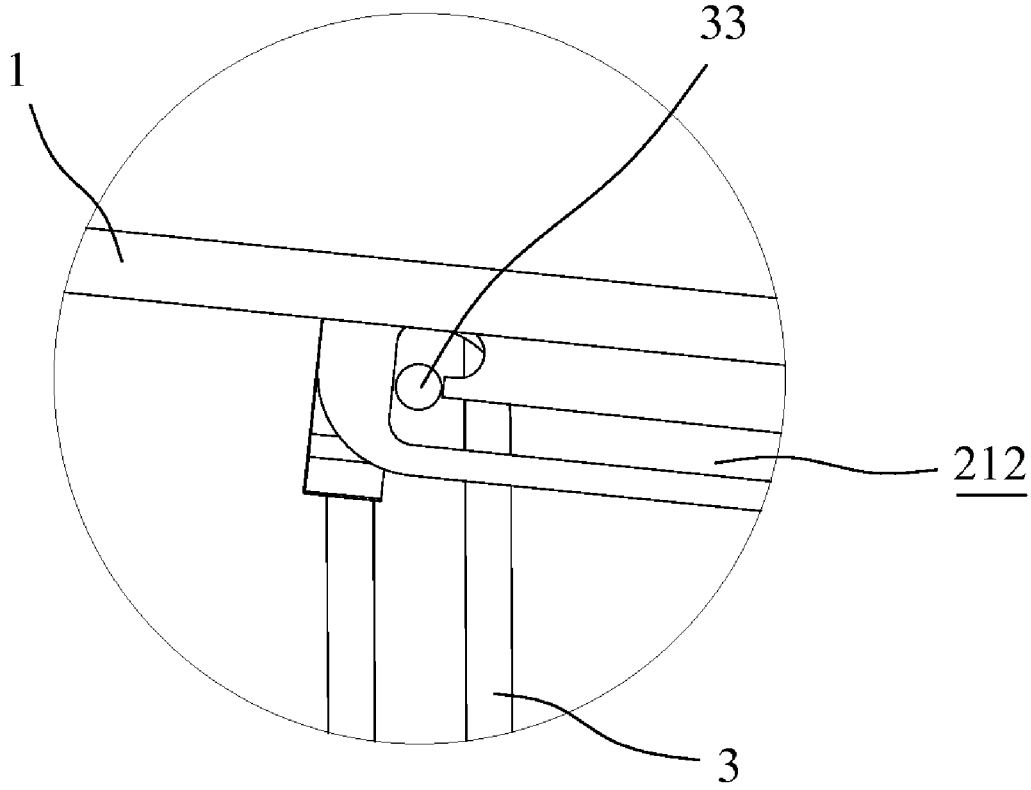
FIG. 6A is an enlarged view of a portion of FIG. 6.
Figure 7:
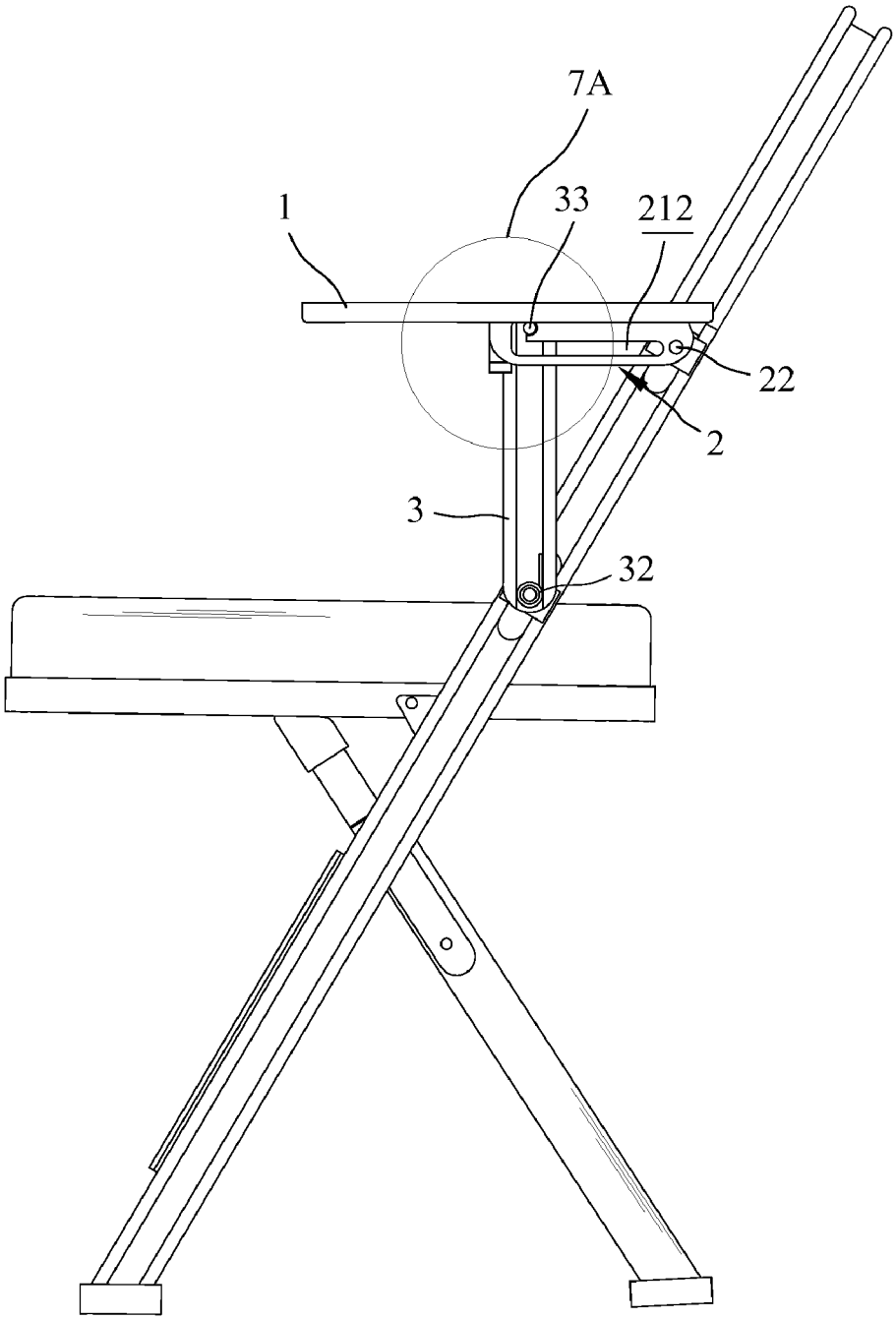
FIG. 7 is a schematic view showing an operation for extending a foldable chair according to an embodiment of the present invention.
Figure 7A:
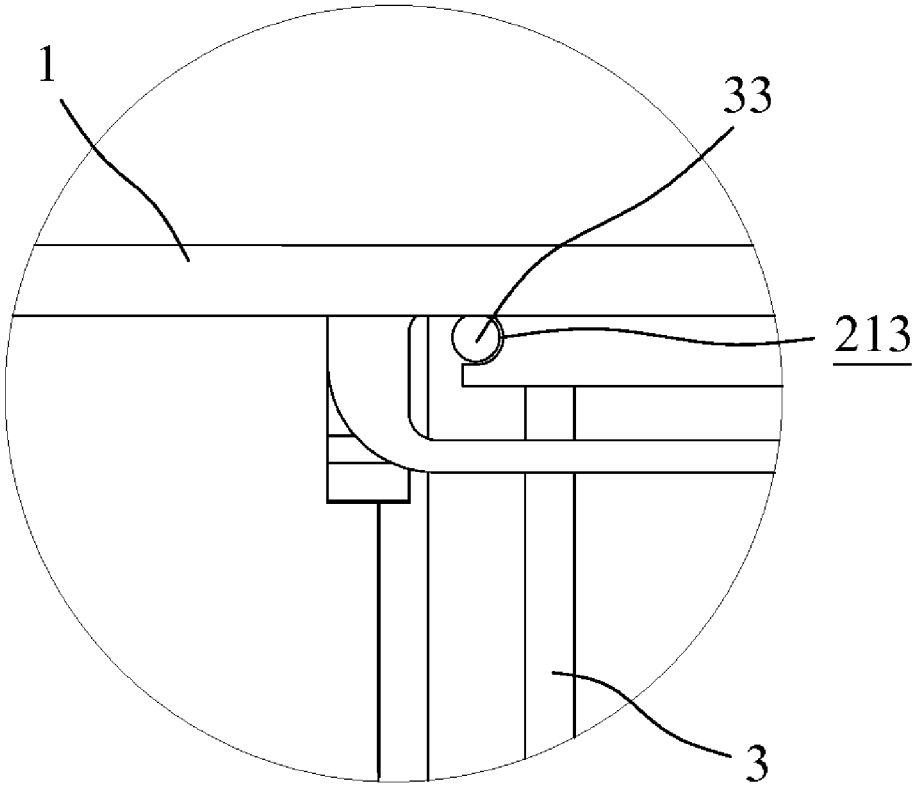
FIG. 7A is an enlarged view of a portion of FIG. 7.
Figure 8:
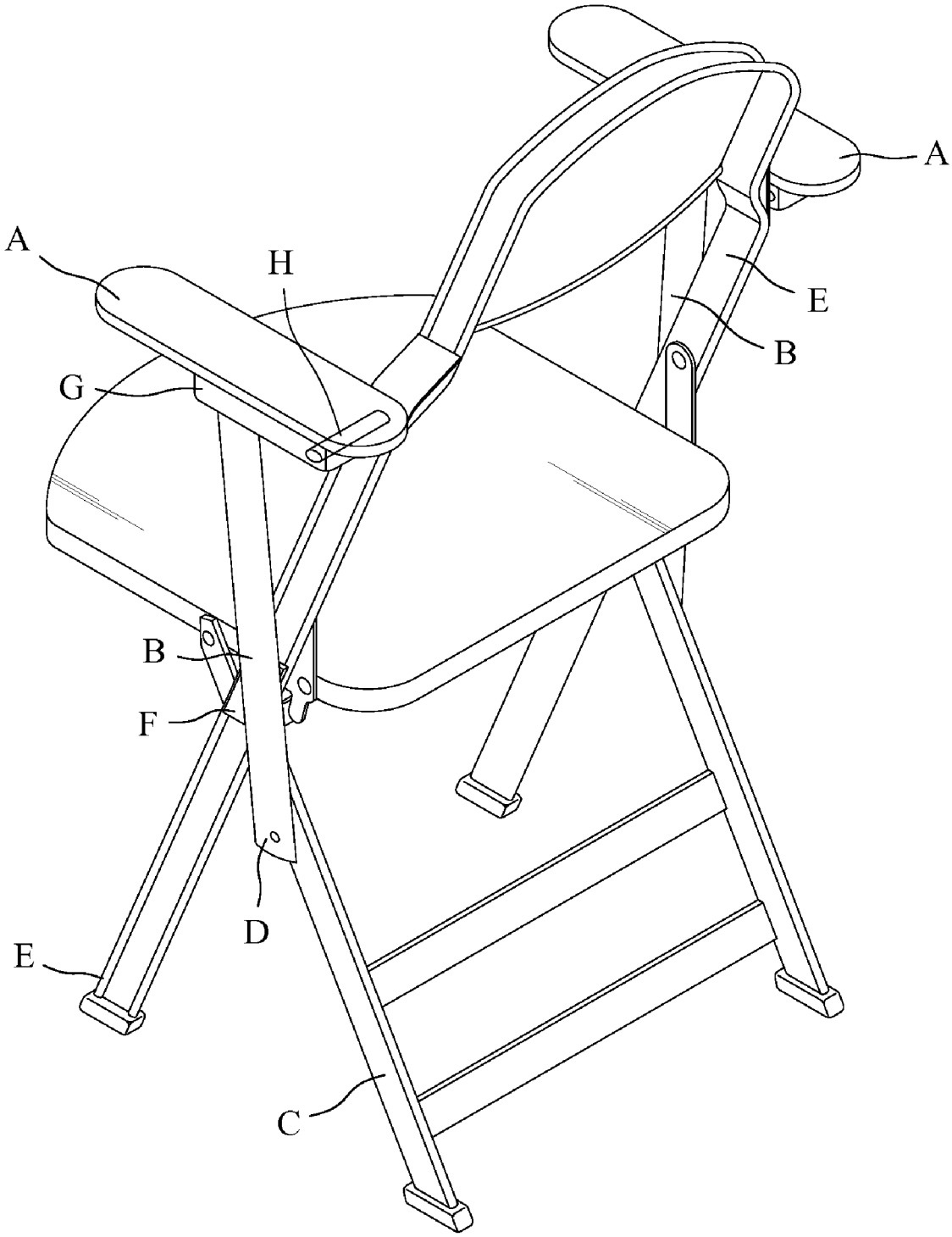
FIG. 8 (PRIOR ART)
FIG. 8 is a schematic view of a conventional foldable chair provided with an armrest retracting structure.

Referring to FIGS. 5 and 5A, when a user wants to use the foldable chair, the front leg frame 4 and rear leg frame 7 are first unfolded. As shown, in the retracted state (initial state) of the armrest retracting structure, the support beam 3 is positioned between the two symmetrical surfaces 211 of the U-shaped plate 21, and the bolt 33 is located at an end of the slots 212 proximate to the first pivotal axle 22. A partial thickness of the support beam 3 is urged between the two symmetrical surfaces of the urging member 5, which causes the armrest 1 and the front leg frame 4 to have a same inclination. Referring to FIGS. 2 and 3A, the armrest 1 is turned upward such that the support beam 3 leaves the urging member 5. As the bolt 33 is mounted across the two symmetrical surfaces 211 and can slide along the slots 212, an end of the support beam 3 can be turned relative to the second pivotal axle 31 to a middle position of the slots 212. Accordingly, a front end of the armrest 1 tilts upward, which causes a load of the spring owing to its free end 321 (see FIG. 3) moving with the support beam 3. Referring to FIGS. 6 and 6A, an end of the support beam 3 and the bolt 33 are biased toward another end of the slots 212, which further accumulates loading on the spring, while the front and rear ends of the armrest 1 reach an approximately horizontal position. Referring to FIGS. 7 and 7A, the end of the support beam 3 is moved until the bolt 33 is lodged into the reverse turn section 213 of the slots 212, which corresponds to a position of the support beam 3 that is approximately perpendicular to the armrest 1. Owing to the force exerted, when the bolt 33 is locked in the reverse turn section 213, the armrest 1 is pulled downward to lie in a completely horizontal position. In this configuration, the spring 32 keeps the accumulated load. With the above operation, the armrest 1 initially in a retracted position can be deployed to a horizontal position. If a user wants to retract the armrest 1, the support beam 3 can be pushed forward so that the bolt 33 disengages from the reverse turn section 213. The armrest 1 then can be biased upward whereas the end of the support beam 3 is slightly moved toward the first pivotal axle 22. By releasing the accumulated load of the spring 32, the support beam 3 can be promptly pushed to move the bolt 33 along the slots 212 back to a position proximate to the first pivotal axle 22. The armrest 1 hence falls on the surface of the support beam 3, and the support beam 3 returns to the position between the two symmetrical surfaces 211 of the U-shaped plate 21, and is urged to pass into the urging member 5. The cushion pad 6 (FIG. 3A) can be used to reduce the noise caused by the collision of the armrest 1 falling on the support beam 3. The armrest 1 can be retracted to a position parallel with the front leg frame 4 (as shown in FIG. 5B).

The foregoing description is intended to only provide illustrative ways of implementing the present invention, and should not be construed as limitations to the scope of the present invention. While the foregoing is directed to embodiments of the present invention, other and further embodiments of the invention may thus be devised without departing from the basic scope thereof, and the scope thereof is determined by the claims that follow.

What is claimed is:

1. A foldable chair having an armrest retracting structure, comprising:

a front leg frame and a rear leg frame pivotally connected with each other, each of two symmetrical sides of the front leg frame including an armrest, and a support beam disposed between each armrest and the front leg frame, wherein a first pivotal link is provided between the front leg frame and the armrest;

a second pivotal link is provided between the support beam and the front leg frame; and a rail is provided between the armrest and the support beam, the rail including a locking portion;

whereby the armrest is operable to retract or deploy separately from a pivoting of the front and rear leg frames so that the armrest may be deployed or retracted independently of a folding of the foldable chair, and the locking portion is able to secure the armrest in a deployed position; and wherein the rail includes two symmetrical slots, an end of the support beam is secured between the two slots through a bolt that is disposed across the two slots and is adapted to drive the end of the support beam to move along the two slots.

2. The foldable chair according to claim 1, wherein a bottom of the armrest moving away from the first pivotal link is provided with an urging member; when the armrest is retracted, the support beam is urged to position in the urging member.

3. The foldable chair according to claim 2, wherein the urging member has resiliency.

4. The foldable chair according to claim 3, wherein the urging member includes two symmetrical surfaces, each symmetrical surface bending outward.

5. The foldable chair according to claim 1, wherein a cushion pad is disposed on a bottom of the armrest.

6. A foldable chair having an armrest retracting structure, comprising:

a front leg frame and a rear leg frame pivotally connected with each other, each of two symmetrical sides of the front leg frame including an armrest, and a support beam disposed between each armrest and the front leg frame, wherein a first pivotal link is provided between the front leg frame and the armrest;

a second pivotal link is provided between the support beam and the front leg frame; and a rail is provided between the armrest and the support beam, the rail including a locking portion;

whereby the armrest is operable to retract or deploy, and the locking portion is able to secure the armrest in a deployed position;

wherein the rail includes two symmetrical slots, an end of the support beam is secured between the two slots through a bolt that is disposed across the two slots and is adapted to drive the end of the support beam to move along the two slots; and wherein the locking portion is formed by a reverse turn portion in the slots in which the bolt is lodged after having been moved.

7. The foldable chair according to claim 6, wherein the two slots are respectively formed on two plates.

8. The foldable chair according to claim 7, wherein the first pivotal link includes a pivotal axle that passes through the two plates and connects with the front leg frame.

9. A foldable chair having an armrest retracting structure, comprising:

a front leg frame and a rear leg frame pivotally connected with each other, each of two symmetrical sides of the front leg frame including an armrest, and a support beam disposed between each armrest and the front leg frame, wherein a first pivotal link is provided between the front leg frame and the armrest;

a second pivotal link is provided between the support beam and the front leg frame; and a rail is provided between the armrest and the support beam, the rail including a locking portion;

whereby the armrest is operable to retract or deploy, and the locking portion is able to secure the armrest in a deployed position; and wherein the second pivotal link includes a pivotal axle that passes through the support beam and connects with the front leg frame, a torque spring being mounted on the pivotal axle.

* * * * *